United States Patent [19]

Totsuka

[11] 4,040,215

[45] Aug. 9, 1977

[54] DECAY-RESISTING CONSTRUCTION OF LOWER STRUCTURE FOR WOODEN BUILDINGS

[75] Inventor: Yasutaro Totsuka, Tokyo, Japan

[73] Assignee: Totsuka Komuten Co., Ltd., Tokyo, Japan

[21] Appl. No.: 688,345

[22] Filed: May 20, 1976

[30] Foreign Application Priority Data

| | | |
|---|---|---|
| May 26, 1975 | Japan | 50-61939 |
| June 23, 1975 | Japan | 50-75633 |
| June 4, 1975 | Japan | 50-74836 |

[51] Int. Cl.[2] ..... E04B 1/92; A01M 1/24

[52] U.S. Cl. ..... 52/168; 43/132 R; 52/294; 52/302

[58] Field of Search ..... 52/168, 302, 515, 516, 52/517, 101, 292, 293, 294; 43/124, 132 R

[56] References Cited

U.S. PATENT DOCUMENTS

| | | | |
|---|---|---|---|
| 274,284 | 3/1883 | Curtiss | 43/124 |
| 697,815 | 4/1902 | Darlington | 52/302 |
| 970,555 | 9/1910 | Riley | 52/302 X |
| 1,507,103 | 9/1924 | Bagwell | 52/168 |
| 1,835,885 | 12/1931 | Lipthrott | 43/124 |
| 2,012,651 | 8/1935 | Beall | 52/101 X |
| 2,087,164 | 7/1937 | Purifoy | 43/124 |
| 2,121,406 | 6/1938 | Purifoy | 52/168 X |
| 2,138,182 | 11/1938 | Lipthrott | 52/101 |
| 2,196,140 | 4/1940 | Coffman | 52/293 X |
| 2,484,062 | 10/1949 | Abbott | 52/302 |
| 2,861,447 | 11/1958 | Lieberman | 52/302 X |
| 2,887,871 | 5/1959 | Chinn | 52/517 X |
| 2,915,848 | 12/1959 | Griffin | 52/101 |
| 3,209,485 | 10/1965 | Griffin | 52/101 |
| 3,273,296 | 9/1966 | Soulon | 52/302 X |
| 3,330,062 | 7/1967 | Carter | 52/101 |
| 3,513,586 | 5/1970 | Meyer et al. | 52/101 X |
| 3,624,953 | 12/1971 | Crosby | 43/124 |

*Primary Examiner*—Leslie Braun

*Attorney, Agent, or Firm*—Blanchard, Flynn, Thiel, Boutell & Tanis

[57] ABSTRACT

A lower structure for wooden building, wherein a groove with open top face is axially formed on the top face of the continuous footing of the building so as to accommodate a wood preserving and insecticidal liquid and a portion of suction materials for said wood preserving and insecticidal liquid affixed to at least a part of the lower structure of the wooden building erected on said footing is disposed in said groove.

8 Claims, 20 Drawing Figures

DECAY-RESISTING CONSTRUCTION OF LOWER STRUCTURE FOR WOODEN BUILDINGS

BACKGROUND OF THE INVENTION

The present invention relates to a wooden building having a lower structure with decay resisting construction.

The cause of deterioration of wooden buildings are generally classified broadly into four categories, namely, weathering, abrasion, decay and damage from insects, and especially the damage by saprogenic bacteria and termites is serious.

The saprogenic bacteria grow in wood in the presence of four factors, namely, oxygen (to wit, air), water (the water content in wood favorable for the growth of said bacteria is in the range of from 25 to 200%, and the optimum content is about 80%), temperature (the temperature favorable for said growth is in the range of from 3° to 45° C, and the optimum temperature is in the range of from 24° to 35° C), nutrient (to wit, sugar, nitrogen compound, cellulose, lignin, etc.), and want of any of these four factors renders the growth thereof impossible. On the other hand, termites eat decayed or wet wood by preference, and particularly early wood and sapwood.

Accordingly, in the case of a wooden building, the rain water infiltrated into the building due to some defect or other of the construction, the used water leaked from the kitchen, the dewdrop from the water supply or drain pipe, etc. flow down to the sill along the column, braces, etc., while, owing to absorption of water or moisture from the continuous footing, the post footing and the surface of the foundation, the framework wood like the sill, leg or column, lower part of brace, etc. and the floor framing wood like the floor post, sleeper, joist, etc. are apt to be always wet, and compared with the upper structure of the building, the damage from saprogenic bacteria and insects is serious. Therefore, for the purpose of improving the durability of a wooden building, it is most important to protect the wood parts of the lower structure of said building against saprogenic bacteria and insects.

With a view to checking the growth of saprogenic bacteria and/or termites, the process of removing the water content and nutrient from wood has hitherto been adopted, and this process is exemplified by the open-cell method, dipping method, coating method, spray method, etc. wherein the subject wood is treated with a solution of some wood preserving agent, namely, antiseptics, insecticides, termite controlling agent, etc. However, said open-cell method and dipping method require large-scale equipment and are expensive so that they are inappropriate for use on the spot of construction, while as for said coating method and spray method, they are admittedly simple and handy, yet they are defective in that the effect thereof is poor in durability and, besides, they are incovenient for sufficiently performing said treatment after construction of the building.

Further, there is known a method of injecting antiseptics upon boring a hole in columns and/or sills. However, this method is defective in that not only it is impossible to replenish the antiseptics after consumption thereof but also the beauty of the building is spoiled thereby.

SUMMARY OF THE INVENTION

Principal object of the present invention is to provide a decay-resisting construction of the lower structure for wooden buildings which will overcome the foregoing defects and solve various questions in the prior art thereby not only simplifying the construction of the lower structure with decay resistance at the time of constructing a wooden building but also rendering it possible to infiltrate a wood preserving and insecticidal liquid into the lower structure as occasion calls even after completing the construction of said building and to maintain the wood parts in arid condition after the wood preserving and insecticidal liquid applied has been consumed.

Another object of the present invention is to provide a decay-resisting construction, wherein a wood preserving and insecticidal liquid is accommodated in a groove formed on the top face of the continuous footing and/or the floor post footing and a suction material for the purpose of sucking up said wood preserving and insecticidal liquid is interposed between the lower structure of wooden building installed upon the footing and said groove, whereby said liquid in the groove can be led to the lower structure to infiltrate therein, the growth of saprogenic bacteria and/or termites can be checked, and accordingly, as the material for sills, a sapwood which is inexpensive but is apt to decay can be substituted for a costly heartwood and, even in the 2 × 4 construction method employing such a sapwood, the decay resistance of wooden buildings can be enhanced.

A further object of the present invention is to provide a decay-resisting construction, wherein a groove for accommodating a wood preserving and insecticidal liquid provided on the top face of the continuous footing and/or the floor post footing is equipped with a liquid supplying hole opening outward and also a ventilation groove which is connected with said liquid accommodating groove almost perpendicularly, whereby at the time when the wood preserving and insecticidal liquid accommodated in the groove has been exhausted as a result of permeation in the lower structure, it can be replenished to the groove repeatedly as occasion calls, while in the case where the liquid accommodating groove has become empty and yet the efficacy of said liquid still remains, it is possible to let air go into beneath the lower structure by way of the liquid accommodating groove as well as the ventilation groove thereby to maintain the lower structure in arid condition and prevent the decay thereof ascribable to moisture.

A still further object of the present invention is to provide a decay-resisting construction, wherein the footing is an integral structure composed of a higher outer footing portion and a lower inner footing portion, said outer footing portion being to support sills and columns while said inner footing portion being to support sills and joists, whereby the wood preserving and insecticidal liquid accommodated in the groove provided on one footing portion can be led into the groove provided on the other footing portion by means of a suction material and the wood preserving and insecticidal liquid in the respective groove is sucked up to the lower structure of the building, namely, sills, columns, joists, etc. to permeate therein by means of the suction materials placed in the respective grooves.

Still another object of the present invention is to provide a decay-resisting construction, wherein the groove for accommodating a wood preserving and insecticidal liquid provided on the top face of the continuous footing and/or the floor post footing consist of a liquid tray which is coated with a substance proof against oils, chemicals and damp or is made of such a substance, whereby said wood preserving and insecticidal liquid is allowed to infiltrate into the lower structure of the wooden building, but it does not infiltrate into the continuous footing and/or the post footing, and accordingly, the continuous footing and/or the post footing are free from corrosion by said liquid and the decay resistance of the building can be enhanced.

DETAILED DESCRIPTION OF THE INVENTION

Figure 1:
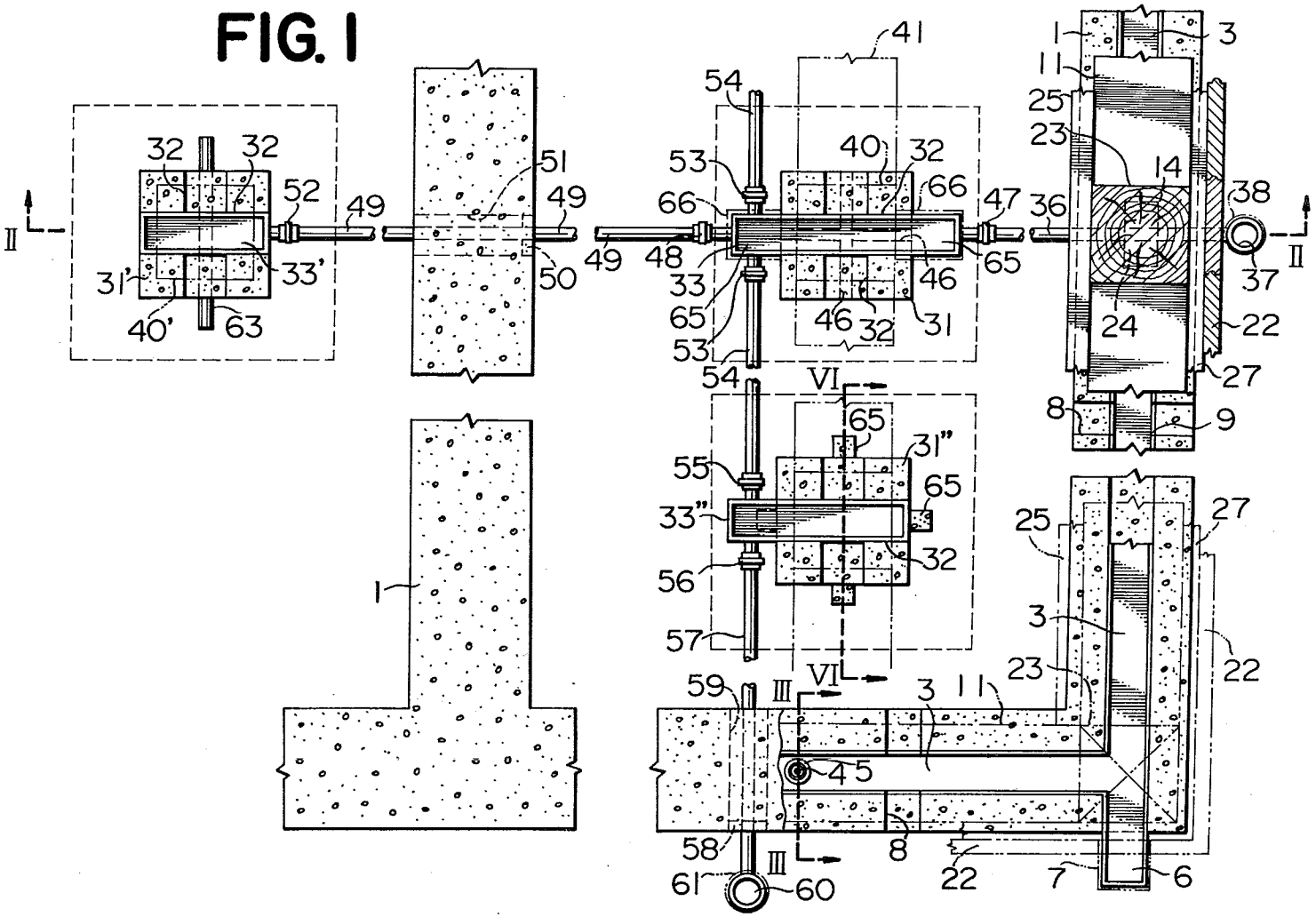
FIG. 1 is a plane figure of a part of a decay resisting construction as the first embodiment of the present invention.

Referring mainly to FIGS. 1 through 4, the reference numeral 1 denotes a continuous footing, and in the practical center of the top face thereof is axially formed a groove 2 with open top face. In the inside of the groove 2 is fitted a liquid tray 3 having a shape practically agreeing with said groove and being capable of accommodating a wood preserving and insecticidal liquid. A portion of this liquid tray 3 extends to the outside of the sheathing 22, and in this portion is formed a supply hole 6 with a detachable cover 7 through which hole the wood preserving and insecticidal liquid is to be injected. An anchor bolt 4 is installed in the continuous footing 1 penetrating the bottom face of the liquid tray 3 to extend upward, and a vinyl chloride pipe 5 with a height equal to the depth of the liquid tray 3 or shorter than it by 2 to 3 mm is disposed to encircle the portion of said anchor bolt 4 located in the liquid tray 3 and the lower end of said pipe is sealed by welding onto the tray 3.

8 denotes optional ventilation grooves provided on the top face of the continuous footing 1 and disposed perpendicularly relative to the axis thereof. The depth of this groove 8 is 4 to 5 mm, and the portion of the liquid tray 3 confronting said groove 8 is provided with an aperture 9 with the same depth.

Figure 2:
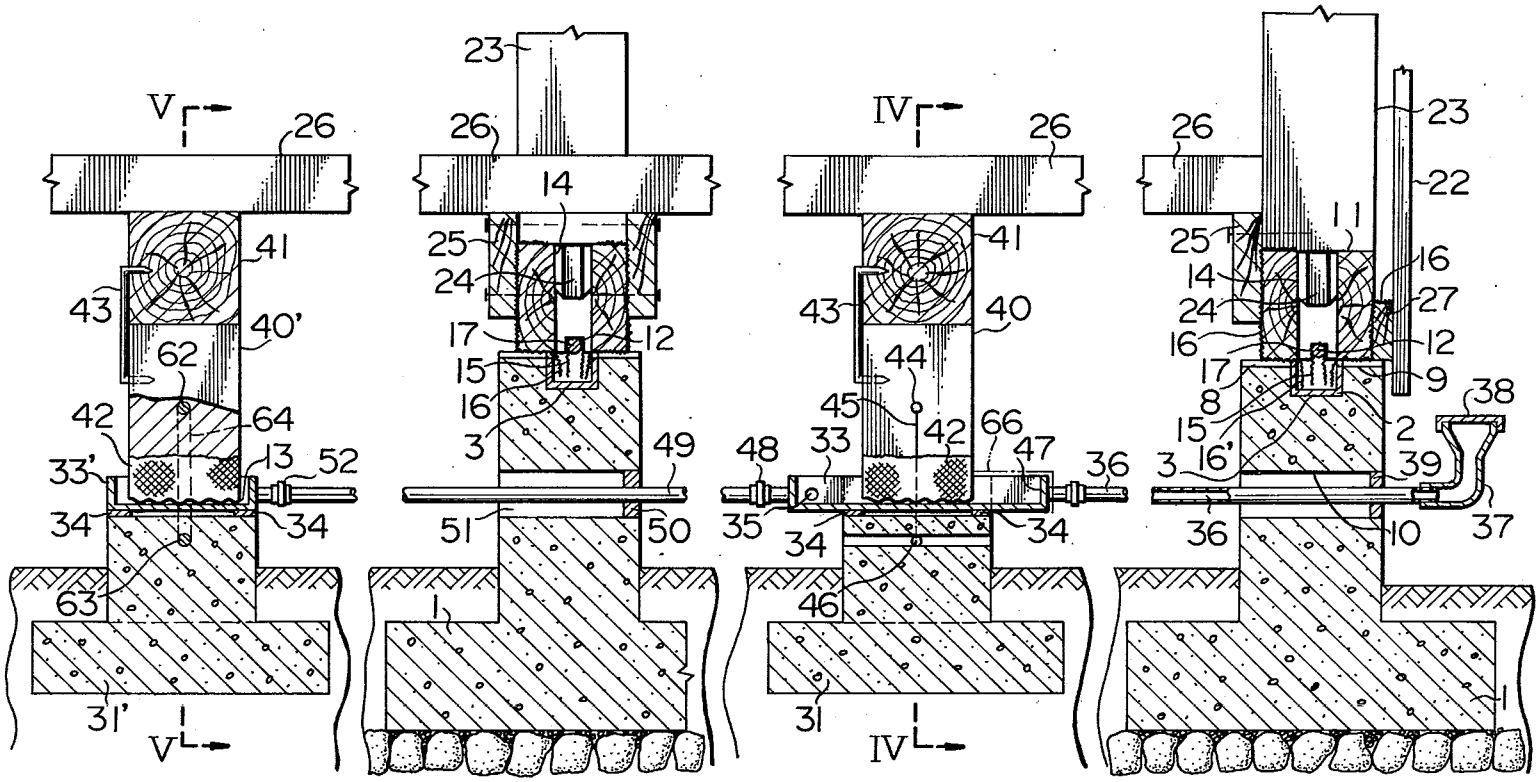
FIG. 2 is a cross-sectional view taken along the line II—II in FIG. 1.
Figure 3:
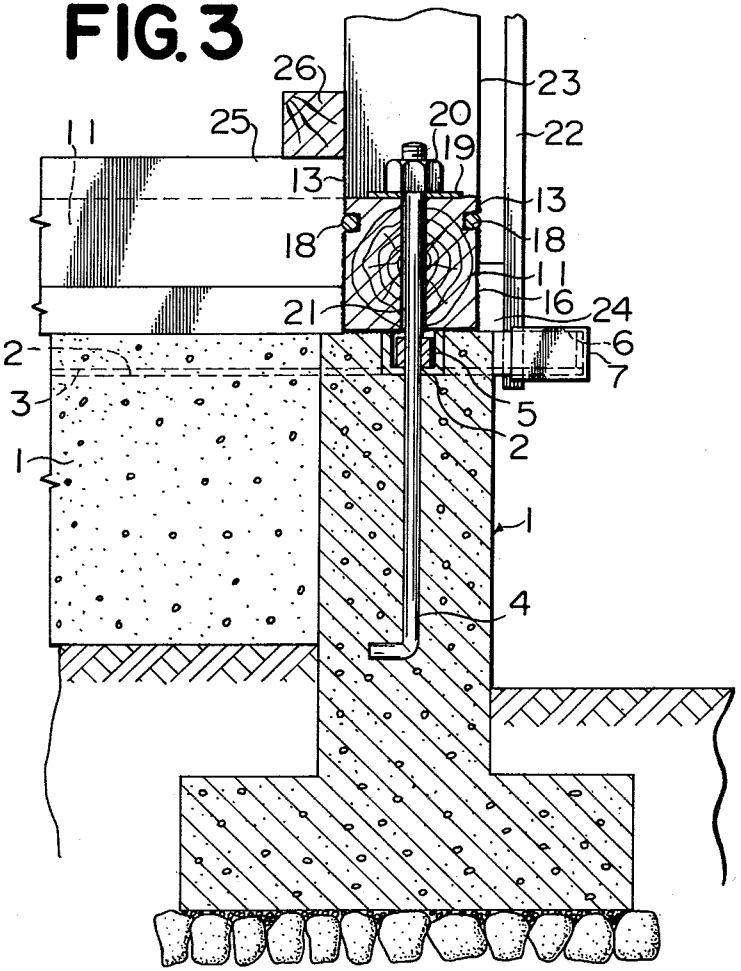
FIG. 3 is a cross-sectional view taken along the line III—III in FIG. 1.

11 denotes a sill laid on the continuous footing 1, whose bottom face confronting the liquid tray 3 is provided with a groove 12 (cf. FIG. 2), and a groove 13 is axially provided on both sides of a portion thereof (cf. FIG. 3). In the groove 12 is fitted the inverted U-shape head of a suction material 15 consisting of linen and the like for sucking up the wood preserving and insecticidal liquid and held in that state by means of an engagement member 17 inserted in the groove, and the two ends of this suction material 15 hang in the groove 3.

On both sides of the sill 11 is affixed another suction material 16, whose lower end 16' hangs in the liquid tray 3 while the upper end thereof is affixed on the sill 11 by means of a ledger strip 25 and furring strips 27 as illustrated in FIG. 2 or affixed on the sill 11 by means of an engagement member 18 inserted in the groove 13 as illustrated in FIG. 3. In this connection, as an alternative means of affixing said suction material 16, it also will do to employ rust-proof nails and/or wires, corrosion resisting strings, etc.

The sill 11 is installed by using anchor bolts 4 coupled with a nut 20 tightly applied thereon through a washer 19.

The column 23 is erected by fitting a tenon 24 thereof in a mortise 14 provided on the sill 11. In this case, if a portion of the suction material covers the sill in such a fashion as illustrated in FIG. 2, it will be held by the lower end of the column 23, and sheathings 22 are fixed on the furring strips 27.

The reference numerals 31, 31' and 31'' denote respectively a concrete footing of a floor post, and on the top face of said concrete footing are provided crossing grooves 32 which are disposed practically parallel and have open top faces. In one end of the groove 32 are disposed liquid trays 33, 33', 33'' capable of accommodating the wood preserving and insecticidal liquid which have a shape almost similar to the groove and are less in depth by about 10 mm than said groove. Beneath said liquid tray is inserted a filler 34 thereby adjusting the top face of the respective trays on every footing to be on the same level.

The post footing consists of an upper part of relatively small area and a lower part of relatively large area as illustrated in the drawings: the ratio of area of said upper part and lower part is in the range of 1:2–10, preferably 1:4–6.

Both ends of the liquid tray 33 of the footing 31 extend to the outside of said footing 31 and are provided with a liquid supplying hole 65 thereon respectively as illustrated in FIG. 1. This liquid supplying hole 65 is provided with a detachable cover 66. One end of the liquid tray 33 is connected to a pipe 36 through a union 47, said pipe 36 being supported in an opening 10 of the continuous footing 1 with the aid of a packing 39 and further extending to the outside through said opening 10. On the extremity of the extension of the pipe 36 is provided a supplying hole 37 for the wood preserving and insecticidal liquid, said supplying hole 37 being equipped with a detachable cover 38. While, the other end of the liquid tray 33 is connected to a pipe 49, which runs along the same direction as the foregoing pipe 36, through a union 48, and said pipe 49 is supported in an opening 51 of another continuous footing 1 with the aid of a packing 50 and further extends to the outside through said opening 51 thereby to be connected to the liquid tray 33′ laid on the footing 31′. The two extremities of this liquid tray 33′ do not extend to the outside of the top face area of the footing 31′. Further, said other end of the liquid tray 33 is connected to a couple of pipes 54 perpendicular to the pipe 49 through a union 53 respectively. This pipe 54 is connected to the end of the liquid tray 33″ laid on the other footing 31″ through a union 55 and extending to the outside of the footing 31″. Onto a position is said liquid tray 33″ corresponding to that of the foregoing pipe 54 is connected a pipe 57 through a union 56. This pipe 57 is supported in an opening 59 of a continuous footing 1 with the aid of a packing 58 and extends to the outside of said opening, and on the extremity of the extension is formed a supplying hole 60 for the wood preserving and insecticidal liquid, said supplying hole 60 being equipped with a detachable cover 61.

40 and 40′ denote a floor post laid on the footings 31 and 31′ respectively. The lower end of the respective floor post is encircled by a suction material 42, and the central part of lower end of this suction material 42 is U-shaped and hangs in the liquid trays 33 and 33′. On both sides of one floor post is held the upper end of a wire 45 by means of the nail 44 respectively, and this wire 45 penetrates an opening 46 provided in the footing 31 thereby linking said footing 31 with said floor post 40 (cf. FIG. 4). A bar 62 penetrates the other floor post 40′ and a bar 63 penetrates the footing 31′, and said bars 62, 63 are tied with wires 64 whereby the footing 31′ and the floor post 40′ are conjoined (cf. FIG. 5).

Figure 5:
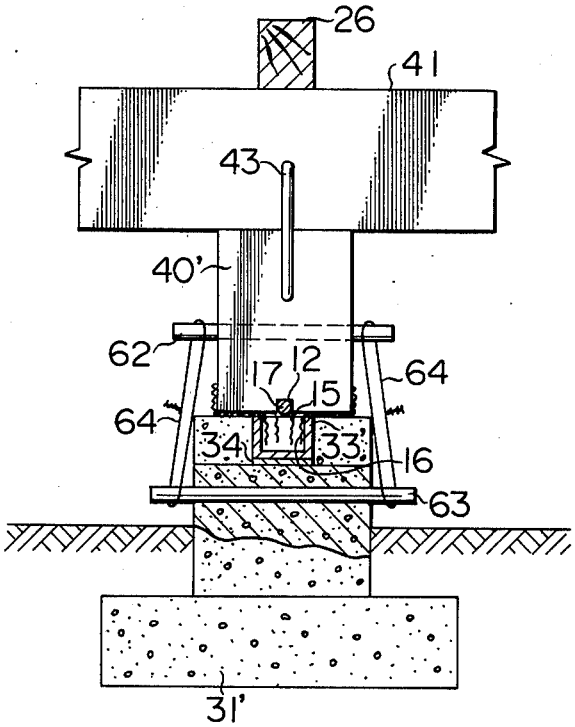
FIG. 5 is a cross-sectional view taken along the line V—V in FIG. 2.
Figure 6:
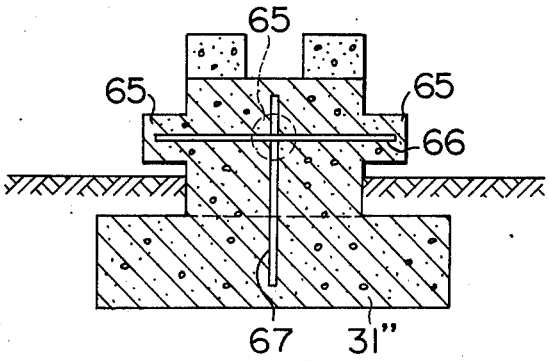
FIG. 6 is a cross-sectional view taken along the line VI—VI in FIG. 1.

Further, another footing 31″ is formed with integral projections 65 as illustrated in FIG. 6 in place of the bar 63 for said footing 31′, and a floor post not shown in the drawing is combined therewith in the same fashion as illustrated in FIG. 5. In this connection, the reference numerals 66 and 67 in the drawing denote reinforcing bars.

Figure 4:
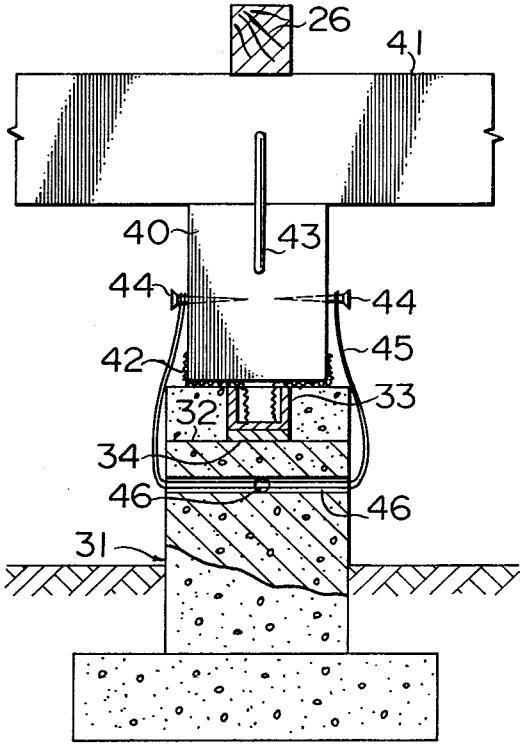
FIG. 4 is a cross-sectional view taken along the line IV—IV in FIG. 2.

FIGS. 4 and 5 are illustrative of typical examples of the mode of uniting the floor post footing with the floor post, yet it goes without saying that any other appropriate means can be adapted in combining the two.

On the floor posts 40 and 40′ is mounted a sleeper 41 which is fastened by means of a clamp 43, and by means of this sleeper 41 and the aforesaid ledger strip 25, the floor joist 26 is supported.

Figure 7:
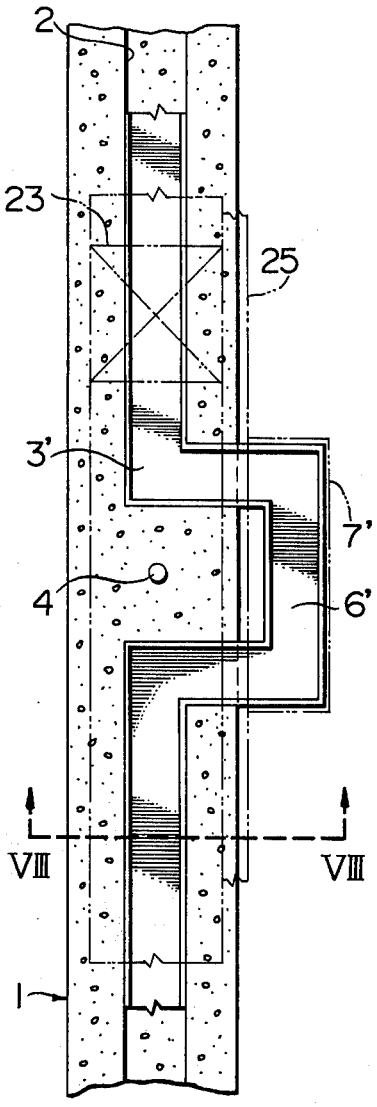
FIG. 7 is a plane figure of one modification of the liquid tray in the first embodiment.
Figure 8:
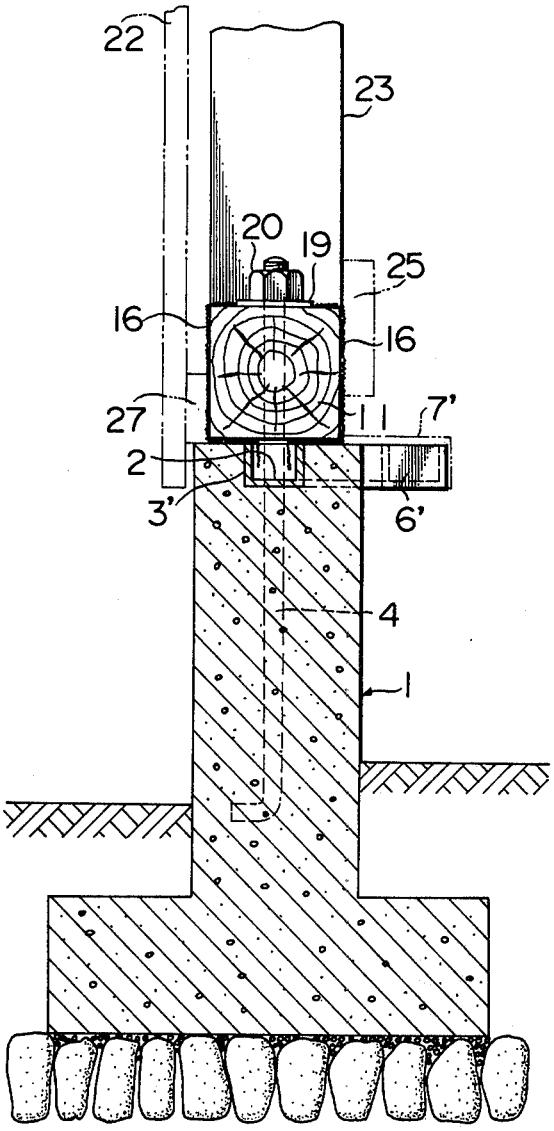
FIG. 8 is a cross-sectional view taken along the line VIII—VIII in FIG. 7.

FIGS. 7 and 8 are illustrative of a liquid tray 3′ different in construction from that in the foregoing examples. This liquid tray 3′ is provided by bending to keep off from the anchor bolt 4 and the thus bent portion thereof projects from the continuous footing 1 under the floor. This bent portion constitutes a supplying hole 6′ for the wood preserving and insecticidal liquid and is equipped with a detachable cover 7′.

FIGS. 9 through 16 are illustrative of varieties of modifications of the mode of installing the suction materials 15 and 16 on the sill 11.

Figure 9:
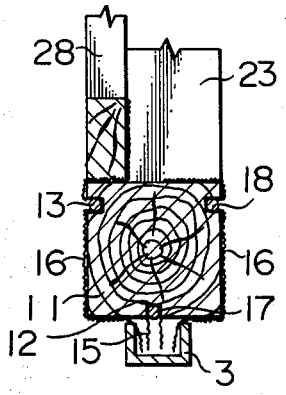
FIGS. 9 through 16 are drawings illustrative of varieties of modifications of the suction material for the wood preserving and insecticidal liquid applicable to the first embodiment.

In the mode shown in FIG. 9, the upper part of the suction material 16 on the left side is held between a brace 28 and a notched portion of the lower end of the column 23.

Figure 10:
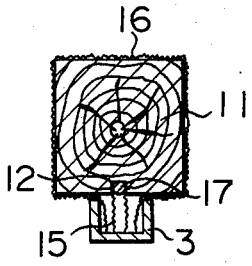

In the mode shown in FIG. 10, the suction material 16 consists of a sheet and said sheet surrounds the sill 11 and both ends thereof hang in the liquid tray 3.

Figure 11:
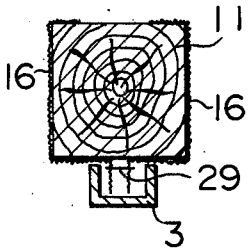

In the mode shown in FIG. 11, a suction material 15 is dispensed with, while both lower ends of a pair of suction materials 16 affixed to both sides of the sill 11 are interconnected by means of a linking member 29 such as strings or cords.

Figure 12:
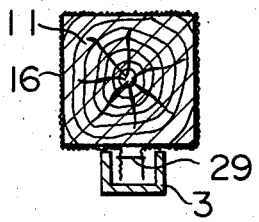
Figure 13:
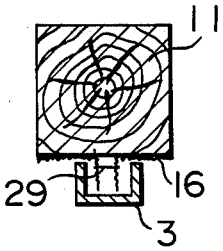

In the mode shown in FIGS. 12 and 13, a single suction material 16 is affixed on the sill 11, respectively, and a loop-shaped portion of the lower end thereof hangs in the liquid tray 3, while the upper part of said loop-shaped portion is linked by means of a linking member 29.

Figure 14:
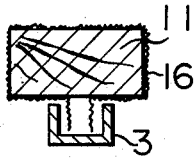
Figure 15:
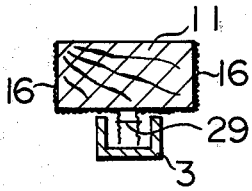
Figure 16:
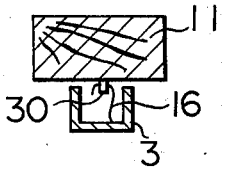
Figure 17:
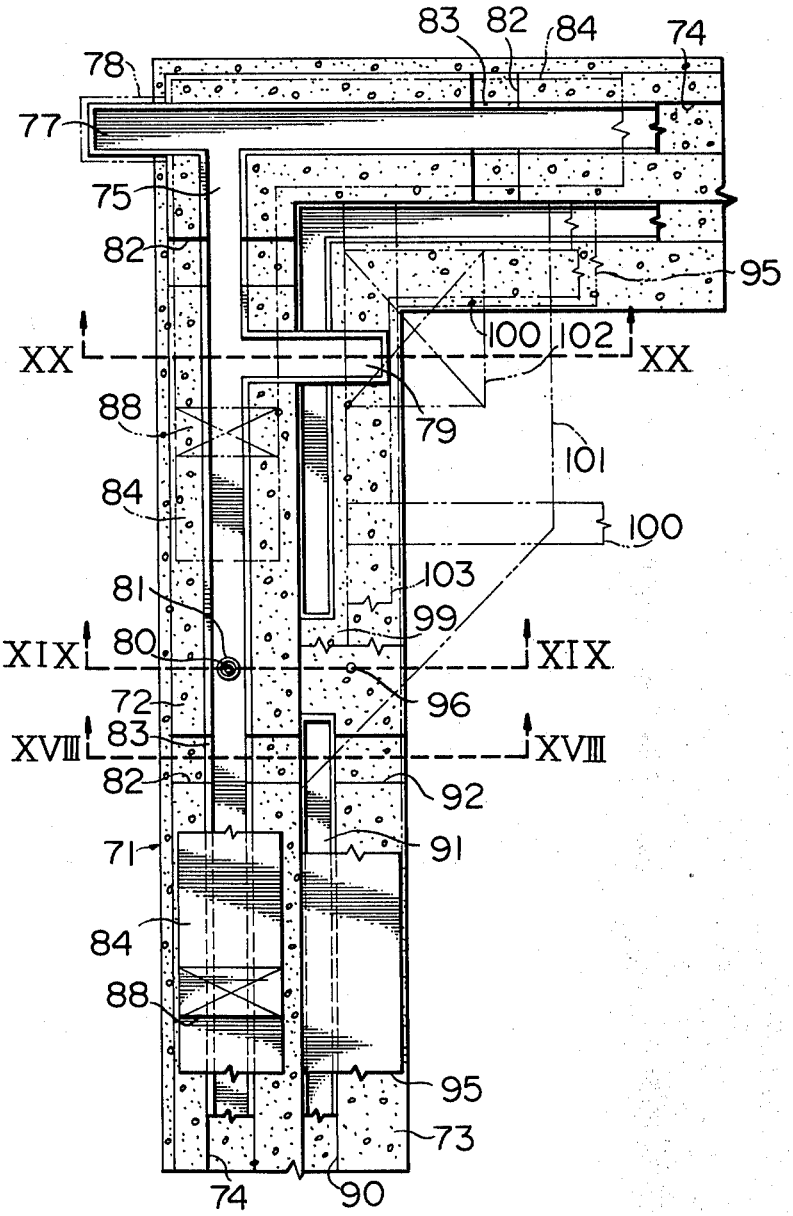
FIG. 17 is a plane figure of a part of a decay resisting construction as the second embodiment of the present invention.

The modes shown in FIGS. 14 through 16 are useful in a two-by-four type wooden building. In these modes, the sill 11 is different in configuration from ordinary ones and is shaped rectangularly. In the mode shown in FIG. 14, both ends of a single suction material 16 hang in the liquid tray 3, in the mode shown in FIG. 15, both lower ends of a couple of suction materials 16 hanging in the liquid tray 3 are linked by means of a linking member 29, and in the mode shown in FIG. 16, a staple 30 is affixed on the bottom face of the sill 11 and a belt-like suction material 16 hangs in the liquid tray 11.

In the above described various lower structures, on the top face, the inner side face, etc. of the footing there is applied a 1–3 mm thick water-proof coating film consisting of a 2-fluid type coating material (e.g., Resibon No. 1240, the manufacture of Resibon Co., Ltd.) which consists essentially of urethane thereby to impart water resistance, oil resistance and chemical resistance to the top face, inner side face, etc. of the continuous footing 1.

As for the configuration of each of the liquid trays 3, 3′, 33, 33′ and 33″, it is not limited to those illustrated in the drawings so long as the top face thereof is open. Also, such a liquid tray can be selectively provided in the dampish and ill-ventilated places where the sill is apt to decay, instead of providing same all over the top face of the continuous footing 1. Further, each liquid tray is preferably composed of a halved square trough made of, for instance, unplasticized vinyl chloride having a high oil resistance as well as chemical resistance: however, in the case where a water-proof coating film consisting of the foregoing coating material is formed on the top face of every footing 1, provision of this liquid tray can be dispensed with. In this event, the liquid supplying holes 6, 6′ are to be stuck to the extension of said coating film, and the exposed portion of the anchor bolt 4 is covered with the same coating film or, as an alternative thereof, a vinyl chloride pipe or the like may be fitted in the hole bored in the sill 11 for setting said anchor bolt therein.

Next, to cite an example of the wood preserving and insecticidal liquid to be accommodated in each liquid tray of the foregoing lower structures, there is a solution obtained by mixing various substances, e.g., an antiseptic like creosote, an insecticidal and termite controlling agent such as chlorodene chloronaphthalene, organic tin compound, etc. and adding thereafter a solvent such as 2,2′-dichloro-diisopropyl ether thereby converting the mixture into an oily matter having a low flash point.

The suction materials 15, 16 and 42 are for the purpose of sucking up the foregoing wood preserving and insecticidal liquid by a capillary action, and are composed of natural fibers like linen, cotton cloth, etc., synthetic fibers like nylon, fibrous material like decay-proof paper, etc. or sheet-like material like glass wool, foamed styrol, etc.

All the pipes, nails, wires, clamps, etc. other than said suction material which have a chance for coming in contact with the wood preserving and insecticidal liquid are preferably made of a material invulnerable to said liquid or subjected to surface treatment therewith.

But, in the case where the wood preserving and insecticidal liquid to be applied consists mainly of creosote oil, the above corrosion-preventive treatment is unnecessary.

When a wooden building has been constructed by applying the above described lower structure, a wood preserving and insecticidal liquid is poured in the liquid trays 3, 3', 33, 33', 33'' and so forth from the supplying holes 6, 6', 37, 60, 65 and so forth through the pipes 36, 49, 54, 57 and so forth, or without resorting to these pipes, to the extent of about 80% of the depth of those liquid trays.

The thus poured wood preserving and insecticidal liquid is sucked up by the suction materials 15, 16, 16' and 42 and infiltrates into the wood parts of the lower structure of the building contacting said suction materials, such as framework wood and floor framing wood, namely, sill 11, column 23, ledger strip 25, furring strips 27, brace 28, floor post 40 and so forth, whereby the lower structure can be prevented from suffering damages due to the decay attributable to saprogenic bacteria, noxious insects, etc.

With the lapse of time, the wood preserving and insecticidal liquid permeates gradually into the lower structure and finally the liquid trays will become empty. Even in this event, the thus emptied condition of the liquid trays is left as it is until the efficacy of the wood preserving and insecticidal liquid permeated into the lower structure is gone. During this period, by virtue of air being circulated by way of the groove 8 and the aperture 9, the lower structure is kept in arid state, and even when it become humid temporarily due to rainfall or other, the arid state will be soon restored, whereby the decay resistancy of the lower structure can be maintained. When the efficacy of the wood preserving and insecticidal liquid permeated in the lower structure is gone, the liquid is again poured in the liquid trays in the same way as above.

Illustrated in FIGS. 17 through 20 is an embodiment of the present invention as applied to a two-by-four type semi-underground structure.

In the drawings, the reference numeral 71 denotes a continuous footing which is composed of a higher outer footing portion 72 and a lower inner footing portion 73.

In the preactical center of the top face of the footing portion 72 is axially provided a groove 74 with open top face. In the inside of the groove 74 there is fitted a liquid tray 75 having a shape practically agreeing with said groove 74. A portion of this liquid tray 75 projects to the outside of an exterior finishing plate 76 provided on the outside of the outer footing portion 72, and in this outwardly projected portion is formed a supplying hole 77 with a detachable cover 78 through which hole the wood preserving and insecticidal liquid is supposed to be injected. Further, an inward projection of the liquid tray is provided wherein another supplying hole 79 is formed.

An anchor bolt 80 is installed in a continuous footing 72 penetrating the bottom face of the liquid tray 75 to extend outward, and a vinyl chloride pipe 81 with a height equal to the depth of the liquid tray 75 or shorter than it by 2 to 3 mm is disposed to encircle the portion of said anchor bolt 80 located in the liquid tray 75 and the lower end of said pipe 81 is sealed by welding onto the liquid tray 75.

82 denotes optional ventilation grooves provided on the top face of the continuous footing 71 and disposed perpendicularly relative to the axis thereof, and the portion of the liquid tray 75 confronting said groove 75 is provided with an aperture 83 with the same depth as the groove 75.

Figure 18:
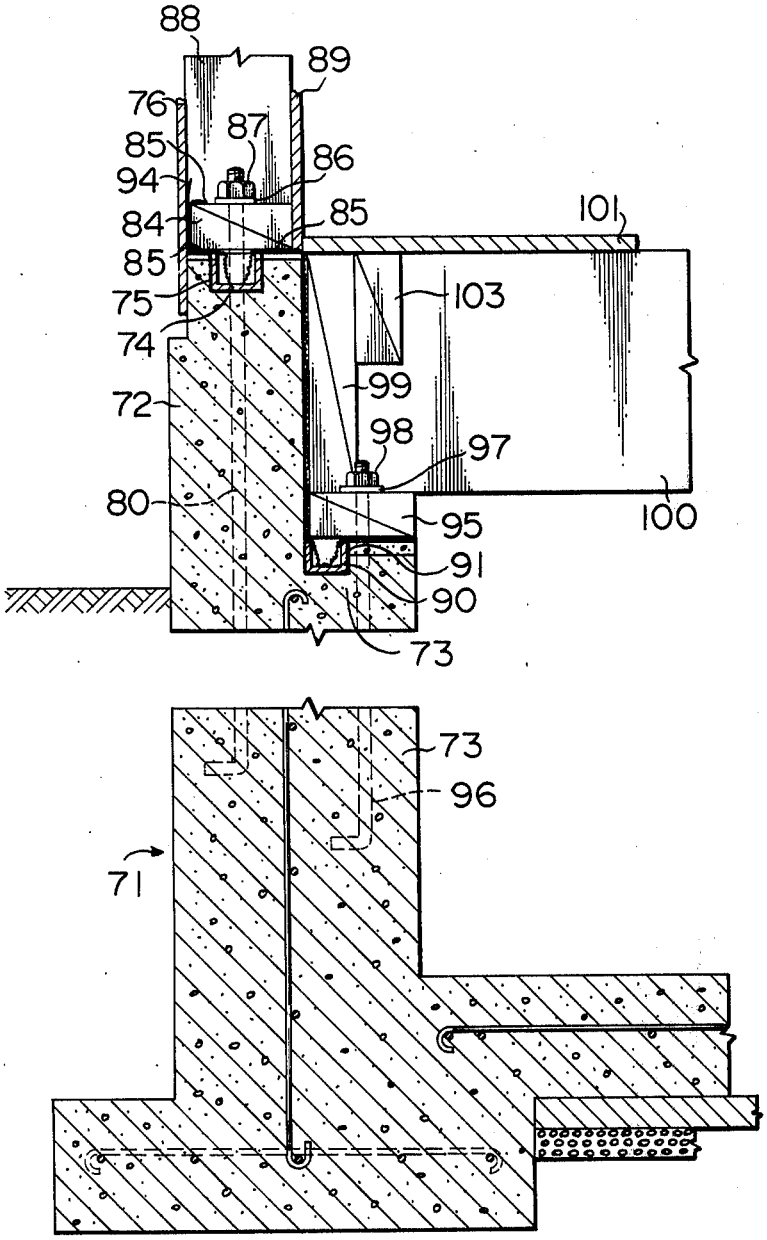
FIG. 18 is a cross-sectional view taken along the line XVIII—XVIII in FIG. 17.
Figure 19:
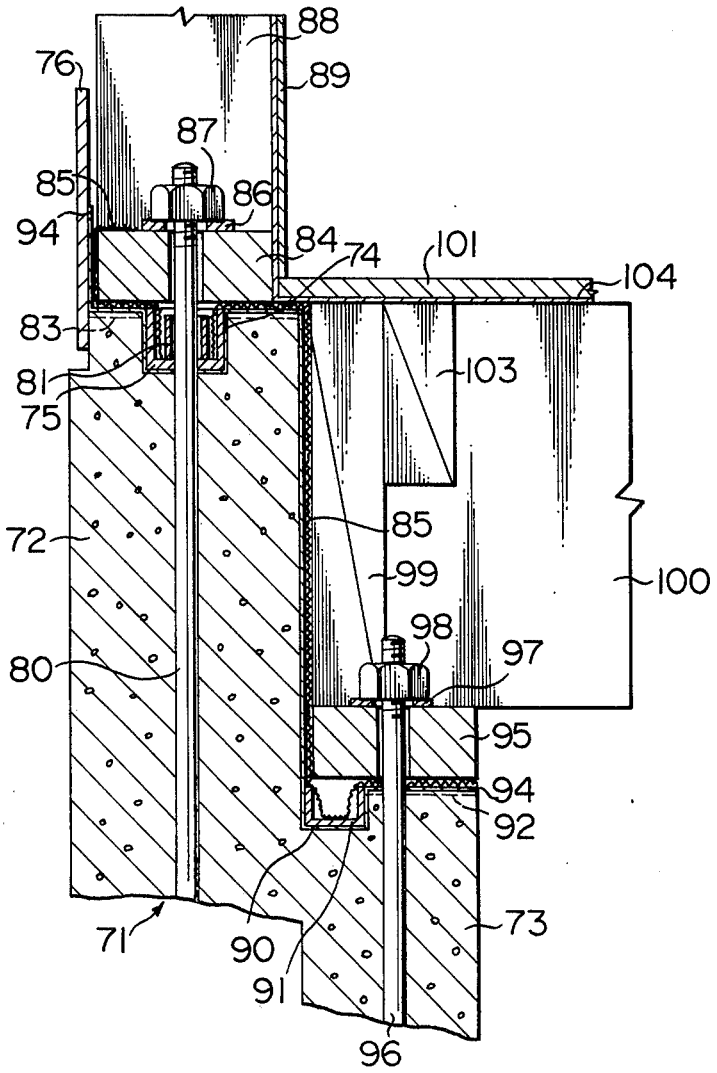
FIG. 19 is a cross-sectional view—on an enlarged scale—taken along the line XIX—XIX in FIG. 17.
Figure 20:
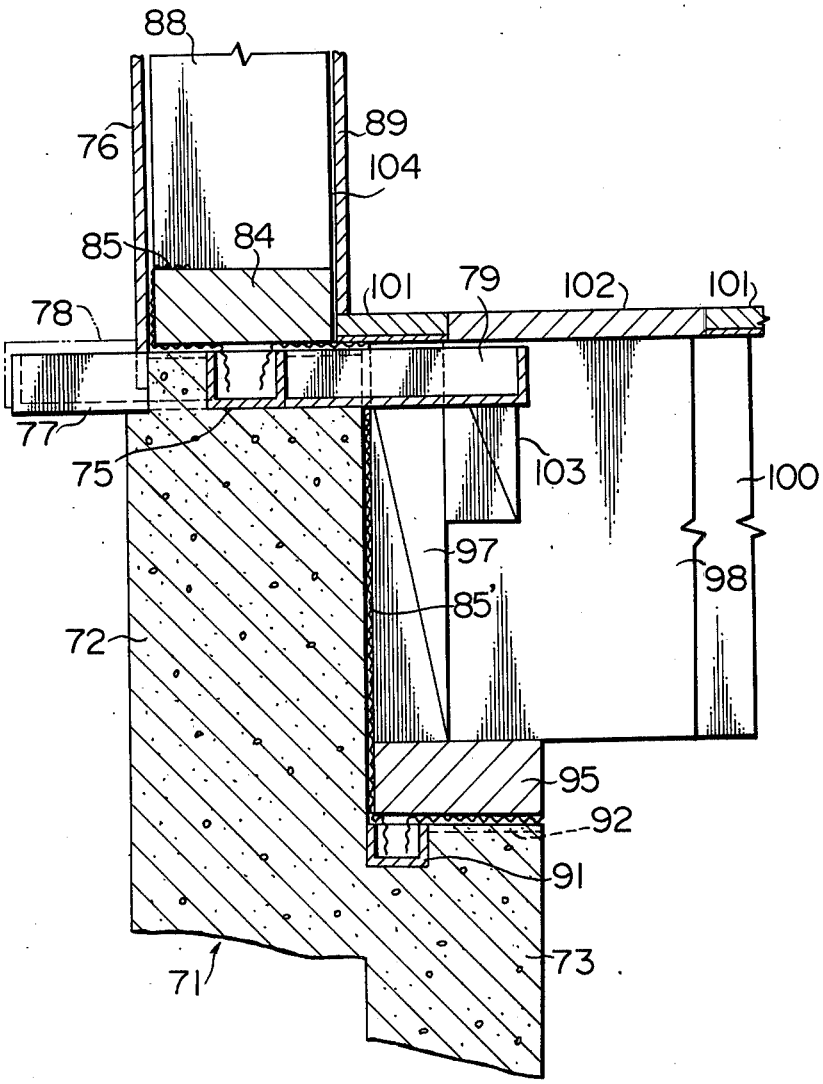
FIG. 20 is a cross-sectional view—on an enlarged scale—taken along the line XX—XX in FIG. 17.

84 denotes a sill consisting of sapwood with a two-by-four section, and on its outer top face, side face and bottom face are affixed a suction material 85. This suction material 85 is bent in U-shape within the liquid tray 75 as illustrated in FIG. 18, and further extends through the interstice between the bottom face of sill 84 and the outer footing portion 72 thereby to be affixed to the inside face of the outer footing portion 72 and made to hang down. In this case, on the top face as well as side face of the outer footing portion 72 and the top face of the inner footing portion 73 can be either applied a coating film of a 2-liquid type coating material or affixed a polyethylene sheet 94 in lieu thereof. Further, a portion of the suction material 85 within the liquid tray 75 may be severed as shown in FIG. 20. In such a way as set forth above, the sill 84 is fixed on the outer footing portion 72 by using anchor bolts 80 coupled with a nut 87 tightly applied thereon through a washer 86.

On the sill 84 is erected the column 88, and on the outer side and the inner side of the column 88 are fixed an interior finishing plate 89 and an exterior finishing plate 76, respectively. On this occasion, the aforesaid polyethylene sheet 94 is affixed to the inside face of the exterior finishing plate 76.

On the top face of the inner footing portion 73 is provided a groove 90 with open top face by disposing along the wall surface of the outer footing portion 72, and in the inside of this groove 90 is fitted a liquid tray 91 having a configuration practically similar to that of said groove 90.

92 denotes optional ventilation grooves provided on the top face of the inner footing portion 73 and disposed perpendicularly relative to the axis thereof, and a portion of the groove 91 corresponding to the groove 92 is provided with an aperture having a similar configuration.

The hanging extension of the foregoing suction material 85 is bent in U-shape within the groove 91 and thereafter is affixed to the top face of the inner footing portion 73.

95 dentoes a sill consisting of sapwood with a two-by-four section, and this sill 95 is fixed on the inner footing portion 73 by means of an anchor bolt 96 coupled with a nut 98 tightly applied thereon through a washer 97. On the sill 95 are installed an end joist 99 and a side joist 100, and the top face of these joists is covered with floor boards 101. A portion of this floor board 101 corresponding to the top face of the aforesaid liquid supplying hole 79 is provided with a detachable trap door 102. 103 denotes a supporting beam. In this connection, the joists 99 and 100 consist of sapwood with a two-by-ten section.

In between the sill 84 and the interior finishing plate and between the floor board 101 and the joists 99 and 100 is fitted a damp-proof material 104 consisting of polyethylene film and the like: in this connection, in lieu of application of said film, it will do to subject the back of the floor board 101 as well as the interior finishing plate to an appropriate damp-proofing treatment.

The materials for every member, the mode of processing and so forth in this embodiment are the same as that in the preceding embodiment.

In a lower structure as set forth above, when a wood preserving and insecticidal liquid is poured in the liquid tray 75 of the outer footing portion 72, said liquid is sucked up by the suction materials 85 and 85' to infiltrate into such parts of the lower structure as the sill 84, the lower portion of the column 88, etc. on the one hand, and on the other hand it descends along the side face of the outer footing portion 72 and reaches to the liquid tray 91 of the inner footing portion 73 thereby to infiltrate into such parts of the lower structure as the joists 99, 100, the sill 95, etc. On this occasion, by virtue of the damp-proof materials 94 and 104, infiltration of said wood preserving and insecticidal liquid into the interior and exterior finishing materials, the floor boards and footings can be prevented.

In the present embodiment, like in the preceding embodiment, when the liquid tray becomes empty, air is led into the liquid tray whereby the lower structure comes to be held in arid state.

What is claimed is:

1. In a building construction having a continuous footing and a plurality of post-type footings, each of said footings having a top face, and a wooden lower structure erected on the footings, the improvement wherein the top faces of the footings are provided with an upwardly opening groove therein, an upwardly opening tray positioned within the respective grooves accommodating therein a wood preserving and insecticidal liquid, said tray being formed by walls which are impervious to said liquid to prevent same from permeating into the footings, a plurality of pipes interconnecting the trays which are mounted on the different footings to permit transfer of said liquid between said trays, and suction material affixed to at least a portion of said lower structure, at least a part of said suction material being positioned within the trays and being in contact with the liquid therein, whereby said suction material sucks up the liquid in said trays and transfers same to said lower structure so that the liquid can permeate the lower structure to protect same.

2. A construction according to claim 1, wherein said suction material comprises a sheetlike fibrous material which is affixed to the lower structure and which hangs downwardly from said lower structure into said trays for contact with the liquid.

3. In combination, a horizontally elongated footing for a building, said footing having a top face, and a wooden lower structure for a building erected on the top face of said footing, the improvement wherein an upwardly facing groove is formed in the top face of said footing accommodating therein a wood preserving and insecticidal liquid, said groove extending longitudinally of the footing and being formed by walls which are impervious to said liquid so as to prevent the liquid from permeating into the footing, and suction material affixed to a least a portion of said lower structure and projecting into said groove and being in contact with the liquid therein, whereby said suction material sucks up the liquid in said groove and transfers same to said lower structure so that the liquid can permeate the lower structure to protect same.

4. The combination of claim 3, wherein the walls of said groove are formed by an upwardly opening tray which is separate from said footing, and a portion of said tray projecting to the outside of the footing to form a supply hole for permitting replenishment of the liquid in the tray.

5. The combination of claim 3, including means communicating with said groove and projecting outside of the footing so as to define a supply hole which permits replenishment of the liquid within the groove.

6. The combination of claim 3, wherein the footing includes a higher outer footing portion and a lower inner footing portion which are disposed directly adjacent one another and formed as an integral unit, said groove being provided in the respective top face of both the inner and outer footing portions, and said suction material having one part thereof positioned within the groove formed in the outer footing portion and another part thereof positioned within the groove formed in said lower footing portion, said parts of the section material being joined by a further part which extends between the grooves formed in the outer and inner footing portions.

7. The combination of claim 3, wherein said footing has transverse ventilation grooves formed across the top face thereof, said ventilation grooves being shallow in contrast to the depth of said liquid-containing groove so as to permit proper ventilation thereof.

8. The combination of claim 3, wherein said suction material comprises a sheetlike fibrous material which is affixed to the lower structure over a long extent thereof, a part of said fibrous material projecting down from said lower structure so as to hang into the groove over a substantial longitudinal extent thereof to permit the liquid to be sucked up by the sheetlike fibrous material.

* * * * *